US010074253B2

(12) United States Patent
Muhammad et al.

(10) Patent No.: US 10,074,253 B2
(45) Date of Patent: Sep. 11, 2018

(54) MARKER DEPLOYMENT

(71) Applicant: Plumis Ltd., Stamford, Lincolnshire (GB)

(72) Inventors: Yusuf Muhammad, Sidcup (GB); Paul Thomas, London (GB); William Makant, Stamford (GB)

(73) Assignee: Plumis, Ltd. (GB)

( * ) Notice: Subject to any disclaimer, the term of this patent is extended or adjusted under 35 U.S.C. 154(b) by 196 days.

(21) Appl. No.: 15/026,584

(22) PCT Filed: Sep. 30, 2014

(86) PCT No.: PCT/GB2014/052943
§ 371 (c)(1),
(2) Date: Mar. 31, 2016

(87) PCT Pub. No.: WO2015/049500
PCT Pub. Date: Apr. 9, 2015

(65) Prior Publication Data

US 2016/0247373 A1 Aug. 25, 2016

(30) Foreign Application Priority Data

Oct. 2, 2013 (GB) ..... 1317464.4

(51) Int. Cl.
*A62C 35/00* (2006.01)
*G08B 15/02* (2006.01)
(Continued)

(52) U.S. Cl.
CPC ..... *G08B 15/02* (2013.01); *A62C 35/026* (2013.01); *A62C 35/68* (2013.01);
(Continued)

(58) Field of Classification Search
CPC ... A62C 35/68; A62C 35/026; A62C 99/0072; G08B 15/001; G08B 15/02; G08B 19/005; B05B 7/2489; B05B 7/26
(Continued)

(56) References Cited

U.S. PATENT DOCUMENTS 5,819,124 A * 10/1998 Somner ..... G08B 13/19632 396/263
7,165,626 B2 * 1/2007 Treddenick ..... A62C 3/0214 169/16
(Continued)

FOREIGN PATENT DOCUMENTS

EP 1 312 888 A1 5/2003
GB 2 337 700 A 12/1999
(Continued)

OTHER PUBLICATIONS

International Search Report, Form PCT/ISA/210, dated Dec. 17, 2014 by the ISA/EP, International Application No. PCT/GB2014/052943, 4 pages.
(Continued)

*Primary Examiner* — Jason Boeckmann
(74) *Attorney, Agent, or Firm* — Ware, Fressola, Maguire & Barber LLP

(57) ABSTRACT

A system is disclosed which is operable to supply fire suppressant material (6) and marker (7) to at least one spray head unit (2) for producing spray having a droplet size less than 1000 μm. The system may be operable in two modes. The system may be operable in fire suppressing mode to supply fire suppressant material to the one or more spray heads and in marker deployment mode to supply fire suppressant material and marker to the one or more spray heads. In fire suppressing mode, the system supplies the fire suppressant material for a long period of time, for example, a few tens of minutes. In marker deployment mode the system
(Continued)

supplies the fire suppressant material and marker to the spray heads for a short period of time, for example, a few tens of seconds.

21 Claims, 4 Drawing Sheets

(51) Int. Cl.

| | |
|---|---|
| ***B05B 7/26*** | (2006.01) |
| ***G08B 15/00*** | (2006.01) |
| ***A62C 35/02*** | (2006.01) |
| ***A62C 35/68*** | (2006.01) |
| ***A62C 99/00*** | (2010.01) |
| ***G08B 19/00*** | (2006.01) |

(52) U.S. Cl.
CPC ..... *A62C 99/0072* (2013.01); *B05B 7/26* (2013.01); *G08B 15/001* (2013.01); *G08B 19/005* (2013.01)

(58) Field of Classification Search
USPC ..... 239/312, 310, 317
See application file for complete search history.

(56) References Cited

U.S. PATENT DOCUMENTS

| | | | | |
|---|---|---|---|---|
| 8,944,174 | B2 | 2/2015 | Thomas et al. | |
| 2003/0168225 | A1* | 9/2003 | Denne ..... | A62C 13/22 169/46 |
| 2005/0040252 | A1 | 2/2005 | Thomann et al. | |

FOREIGN PATENT DOCUMENTS

| | | | |
|---|---|---|---|
| WO | 93/07233 | A1 | 4/1993 |
| WO | 01/62344 | A1 | 8/2001 |
| WO | 2010/058183 | A1 | 5/2010 |

OTHER PUBLICATIONS

Bibliographic Data including English Abstract, EP1312888A1, 2 pages.

* cited by examiner

MARKER DEPLOYMENT

FIELD OF THE INVENTION

The present invention relates to a system for and a method of deploying a marker.

BACKGROUND

WO 93/07233 A1 describes a composition comprising a fluorescent material which can be applied to articles or goods for reducing unauthorised removal of or damage to articles or goods or for preventing damage to property. A sprinkler system operated by a burglar alarm can be used to spray the fluorescent material.

SUMMARY

According to a first aspect of the present invention there is provided a system comprising at least one spray head unit operable to supply fire suppressant material and marker (or "tracer") to the at least one spray head unit for producing spray (or "mist") having a droplet size less than 1000 μm.

Unlike a sprinkler system which produces larger droplets which fall to ground, a spray results in droplets which can be suspended in the air, or remain suspended in the air for longer, and so increase the probability that an intruder will be marked.

The system may be a fire suppression system operable, in a fire suppressing mode, to supply fire suppressant material to the at least one spray head unit and, in a marking mode, to supply the fire suppressant material and the marker to the at least one spray head unit.

According to a second aspect of the present invention there is provided a fire suppression system operable, in a fire suppressing mode, to supply fire suppressant material to at least one spray head unit and, in a marking mode, to supply fire suppressant material and marker (or "tracer") to the at least one spray head unit.

The mode may be selected according to trigger type, for example, a trigger generated by a fire detector or a trigger generated by an intruder detector or burglar alarm. Thus, a system which is used for fire suppression can also be used for marking (or "tagging") articles and intruder entering a space which is served by the system.

The at least one spray head unit may be suitable for producing spray (or "mist") having a droplet size less than 1000 μm.

The fire suppressant material may be water.

The marker may comprise a traceable liquid comprises a chemical or biochemical molecule or compound. The marker may comprise a fluorescent material. The marker may be soluble in the fire suppressant material. The marker may be suspended in the fire suppressant material.

The fire suppression system may be configured, in the fire suppressing mode, to supply fire suppressant material for a first duration of time and/or until instructed by a user. The first duration may be at least 10 minutes, at least 20 minutes or at least at least 30 minutes. The first duration may be no more than 30 minutes.

The fire suppression system may be configured, in the marking mode, to supply fire suppressant material for a second, different duration of time. The second different duration of time is preferably less than the first duration of time. The second duration may be no more than 1 minute, no more than 30 seconds, no more than 20 seconds or no more than 10 seconds. The second duration may be at least 5 seconds or at least 10 seconds.

The system comprises at least one spray head unit. The, or each, spray head unit may comprise one or more spray heads.

The system may comprise at least one pressure generator for supplying fire suppressant material to the at least one spray head under pressure.

The system may comprise a controller which, in response to a first activation signal, causes fire suppressant material to spray out from the at least one spray head of the at least one spray head unit and, in response to a second activation signal, causes fire suppressant material and marker to spray out from the at least one spray head of the at least one spray head unit.

The system may comprise first and second paths between an input for fire suppressant material and an output. The system may comprise a first valve which, when open, supplies fire suppressant material to the first path. The system may comprise a second valve which, when open, supplies fire suppressant material to the second path. The system may comprise a reservoir containing the marker and a mixer disposed in the second path and coupled to the reservoir for adding the marker to the fire suppressant material.

The system may comprise a pressurised container holding the fire suppressant material (for example water) and, optionally, an additive (such as the marker). Thus, the system need not include a pump and/or need not be connected to mains water. The system may comprise two or more pressurised containers.

The at least one spray head unit may be wall-mounted spray head unit(s).

According to a second aspect of the present invention there is provided a kit for a fire suppression system. The kit may comprise at least one spray head unit, at least one pressure generator for supplying fire suppressant material to the at least one spray head unit under pressure, a reservoir for storing the marker, a mixer for selectively adding the marker to the fire suppressant material and a controller which, in response to a first activation signal, causes fire suppressant material to spray out from the at least one spray head of the at least one spray head unit and, in response to a second activation signal, causes fire suppressant material and marker to spray out from the at least one spray head of the at least one spray head unit. The kit may further comprise the marker.

According to a third aspect of the present invention there is provided a method of operating a controller of a fire suppression system. The method comprises, in response to a first activation signal, causing pumping of fire suppressant material (without marker) and, in response to a second activation signal, causes pumping of fire suppressant material and marker.

According to a fourth aspect of the present invention there is provided a computer program which, when executed by controller of a fire suppression system, causes the controller to perform the method.

According to a fifth aspect of the present invention there is provided a computer readable medium (which may be non-transitory) storing the computer program.

BRIEF DESCRIPTION OF THE DRAWINGS

Certain embodiments of the present invention will now be described, by way of example, with reference to the accompanying drawings, in which.

DETAILED DESCRIPTION OF CERTAIN EMBODIMENTS

Figure 1:
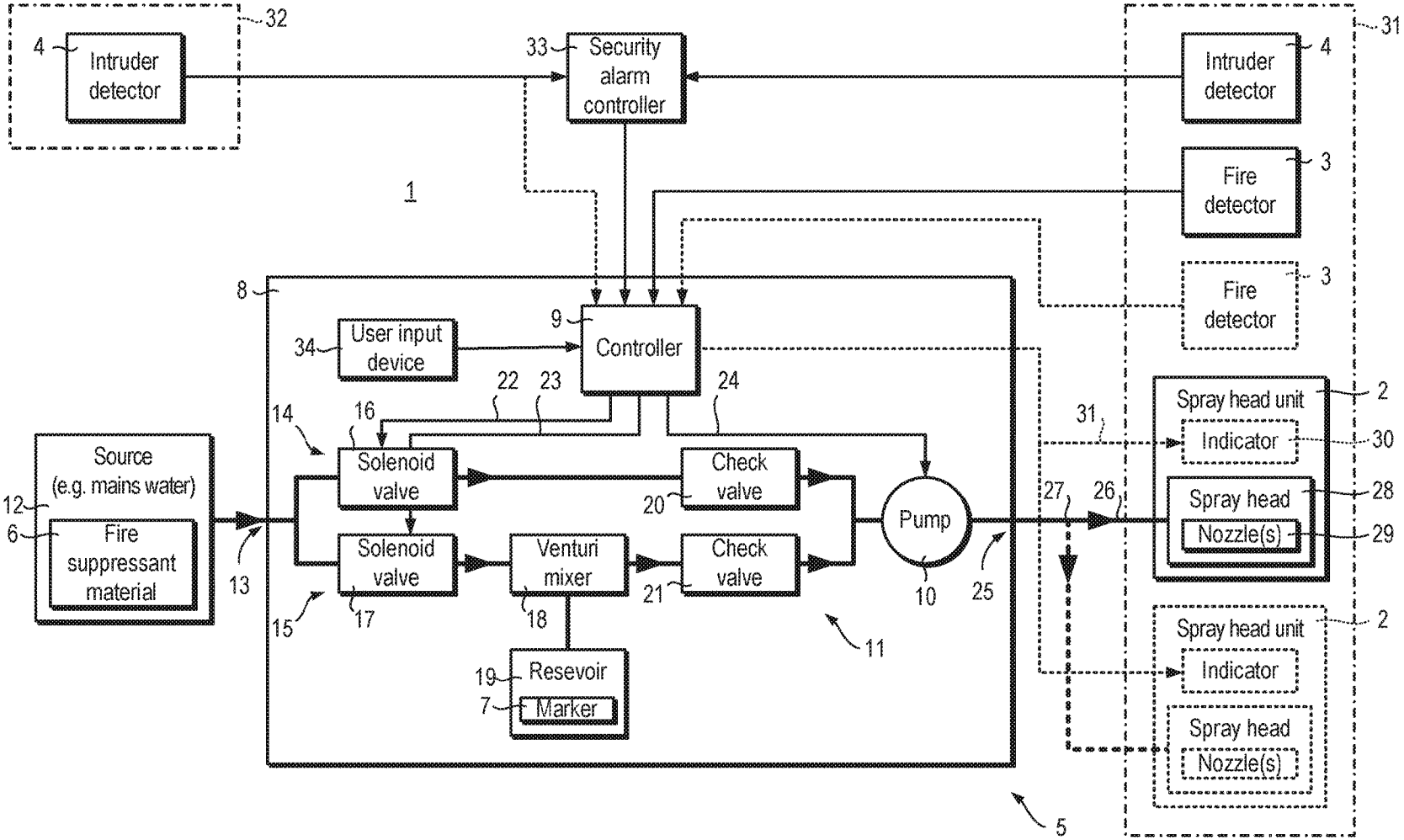
FIG. 1 is a schematic block diagram of a security and fire suppression system.

Referring to FIG. 1, a security and fire protection system 1 is shown.

The system 1 includes at least one spray head unit 2, at least one fire detector 3, at least one intruder detector 4 and apparatus 5 for delivering fire suppressant material 6, such as water, or a mixture of fire suppressant material 6 and a marker 7, such a fluorescent material, to the at least one spray head unit 2 under pressure.

The apparatus 5 may be housed in a single unit 8.

The delivery apparatus 5 comprises a controller 9, a pump 10 and a switch arrangement 11. As shown in FIG. 1, fire suppressant material 6 is supplied from a source 12 via an inlet 13 and into the switch arrangement 11. When the fire detector(s) 3 detect a fire, it sends a trigger as an activation signal (either by a wired link or wireless link) to the controller 9. The general principle of operation of the system as a fire protection system is described in WO 2010 058183 A which is incorporated herein by reference.

The switch arrangement 11 includes first and second paths 14, 15 between the inlet 13 and the pump 10. Each path 14, 15 include a solenoid valve 16, 17. The second path 15 includes a mixer 18, for example in the form of a Venturi mixer 18, which is coupled to a reservoir 19 holding the marker 7. The paths 14, 15 feed into the pump 10 via non-return valves 20, 21. The first path 14 may include a mixer (not shown) coupled to a respective reservoir (not shown) holding an additive which promotes fire suppression.

As shown in FIG. 1, first and second control lines 22, 23 provide respective signals for controlling operation of the first and second solenoid valves 16, 17 respectively and a third control line 24 is used to control operation of the pump 10.

When the delivery apparatus 5 is primed, both the first and second solenoid valves 16, 17 are closed and the pump 10 is not activated. When the delivery apparatus 5 is triggered, one of the of the first and second solenoid valves 16, 17 are opened, and the pump 10 is activated. Flow of fire suppressant material 6 in the second path 15 causes the marker 7 to be added to the fire suppressant material 6. Thus, the delivery apparatus can be used to deliver (when activated) the fire suppressant material 6 (without marker 7) or a mixture of the fire suppressant material 6 and the marker 7. As will be explained hereinafter, the selection of material and the duration of activation depend on whether the system is operating in a fire suppressing mode or a marking mode.

One or more pressurized containers (not shown) can be used. The, or each, pressurized container contains fire suppressant material 6 and, optionally, marker 7. Thus, the pump 10 can be omitted, although it need not be omitted. The container(s) need not be connected or permanently connected to mains water supply, although the containers can be charged using mains water supply and then pressurised using a pump, a compressed gas source or other form of pressurizing means. One pressurised container can be used in fire protection mode and/or one pressurised container can be used in marking mode.

The delivery apparatus 5 includes an outlet 25. The outlet 25 is coupled to the at least one spray head 2 via piping 26. The piping 26 may include 'T'-piece(s) 27 to allow a single pump 10 to supply the fire suppressing material 6 (or fire suppressing material/marker mixture 6, 7) to more than one spray head unit 2.

Figure 2:
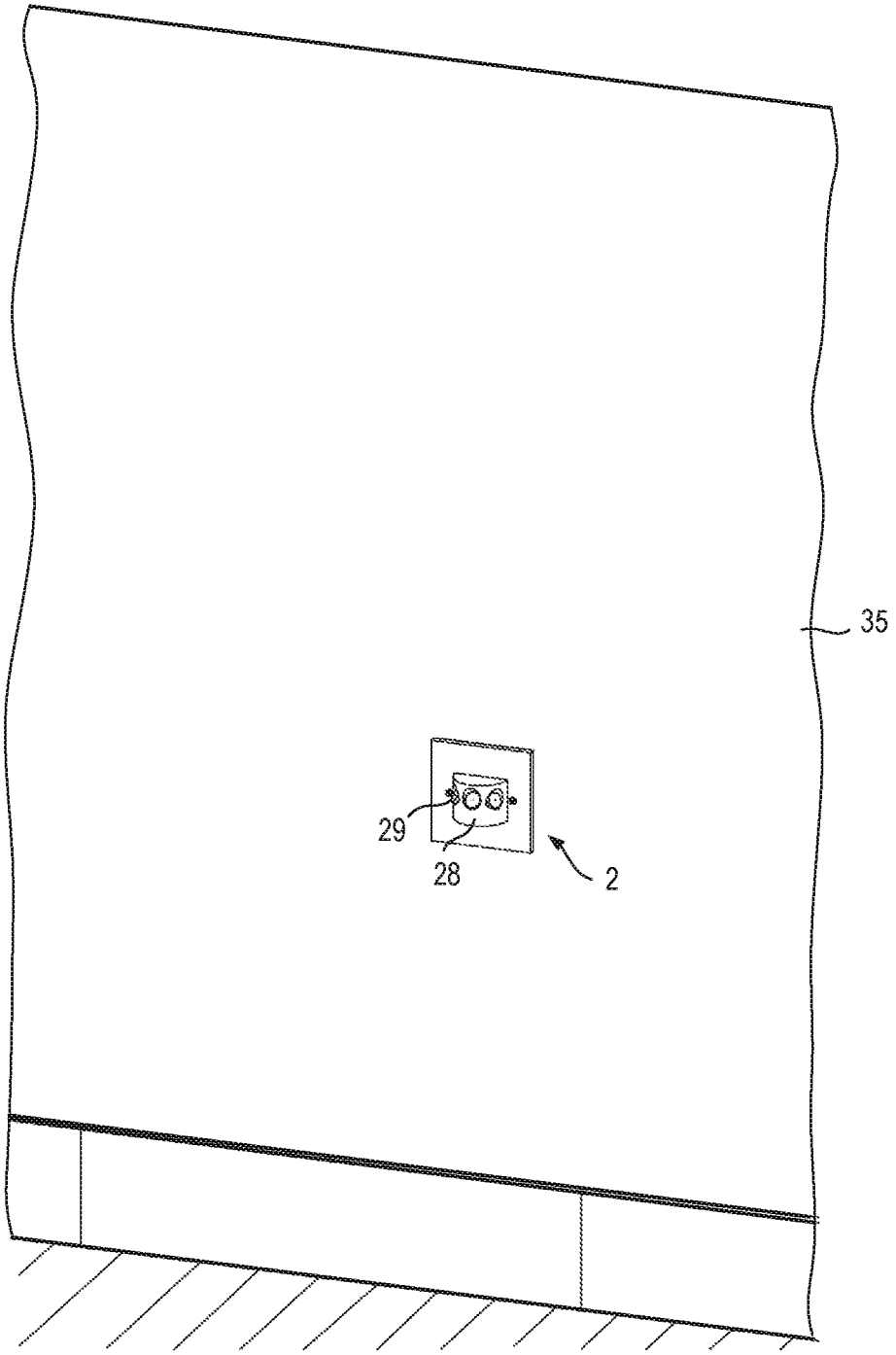
FIG. 2 illustrates a wall-mounted spray head unit.

Referring also to FIG. 2, the, or each, spray head unit 2 has a spray head 28 which includes one or more nozzles 29. Preferably, the spray head 2 comprises three nozzles 29 arranged to provide three overlapping sprays in a wide-angled (e.g. around 180° azimuthal arc) pattern. The spray head 28 produces a mist (or "spray") formed of droplets having droplet size(s) less than 1000 μm.

The, or each, spray head unit 2 may include an indicator 30 for indicating that the system is primed. The controller 9 provides a low-voltage (e.g. <12V) status signal via line 31 to the indicator 30.

As shown in FIG. 1, the spray head unit 2 and the fire detector 3 may be co-located in one space 31, such as, for example, a room. An intruder detector 3, such as passive infrared sensor, may also be co-located in the space 31. However, one or more intruder detectors 4 may be located in another, different space 32, such as, for example another room.

The system 1 includes a burglar alarm controller 33 which receives triggers from the intruder detectors 4. Thus, when a trigger is received, the burglar alarm controller 33 transmits (wirelessly or by wire) an activation signal to the delivery apparatus controller 9. However, the burglar alarm controller 33 may be omitted and the intruder detectors 4 may provide a trigger as an activation signal, directly to the delivery apparatus controller 9.

The delivery apparatus 9 is also provided with a user interface 34, which may simply be a push button (or "stop button"), to close an open valve 16, 17 and deactivate the pump 10.

As shown in FIG. 2, the, some of or each spray head unit 2 is (are) mounted to a wall 35. However, a spray head unit 2 need not be wall mounted, but can be under tap or worktop spray head units 2. A spray head unit 2 can be mounted on a surface which may be horizontal, vertical or angled. For example, a spray head unit 2 can be mounted to a cupboard wall or stairs.

When the delivery apparatus 5 is activated in fire protection mode, the pump 9 delivers water 6 at high pressure, in this example about 80 bar (80 kPa), and the spray head 29 sprays a fine mist of water 6. Typically, when triggered, in fire protection mode, the delivery apparatus 5 delivers fire suppressant material 6 for about 30 minutes or until the user deactivates the system using the user interface 34.

When the system 1 is activated in marking mode, the pump 9 delivers water 6 and marker 7 at high pressure and the spray head 29 sprays a fine mist of water 6 and marker 7. However, the delivery apparatus 5 delivers the fire suppressant material 6 and marker 7 for a much shorter period of time, for example, about 10 or 20 seconds.

Figure 3:
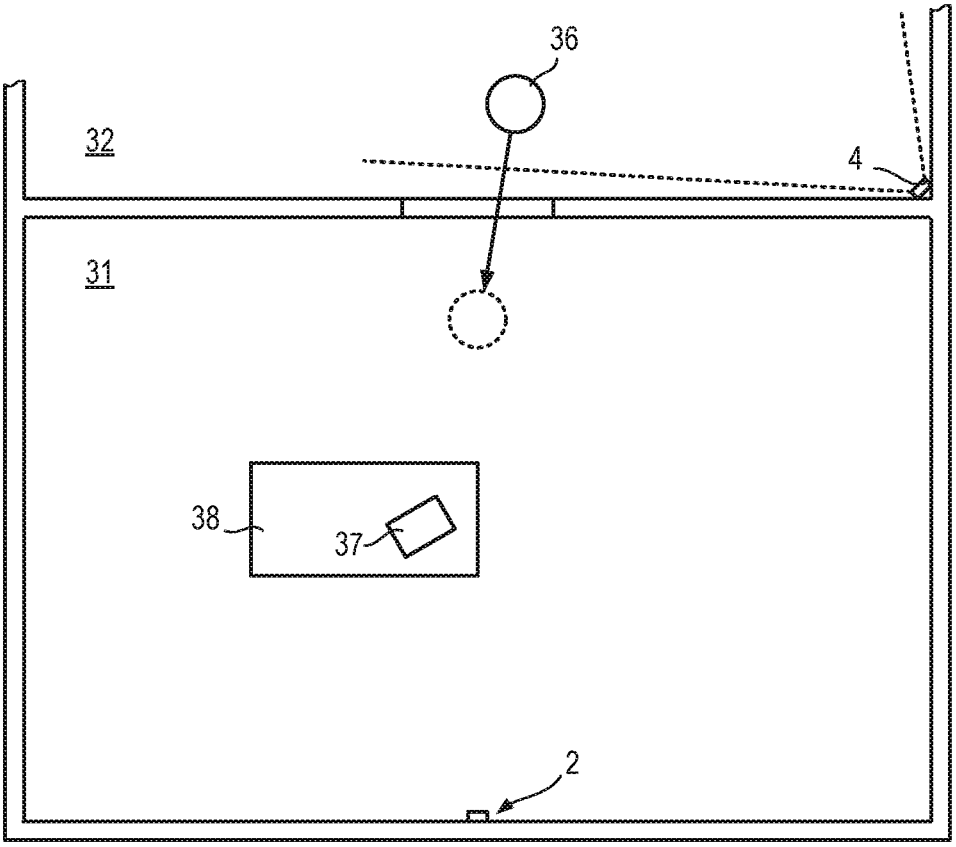
FIG. 3 is a plan view of a room installed with a spray head unit.

Referring to FIG. 3, if an intruder 36 triggers the intruder detector 4, then the delivery apparatus 5 (FIG. 1) causes a mist of water 6 and marker 7 to be sprayed in a room 31.

The mist 6, 7 may settle on valuable articles 37, in this case sitting on a table 38, while also staying airborne.

The intruder 36 may trigger an intruder alarm 4 which is in the same room 31 as the spray head unit 2 or in a different room 32.

If the intruder 36 triggers the intruder alarm outside the room 31 and then enters the room 31, then he or she may still be coated by the marker 7 if it airborne. However, the mist may be barely perceptible to the intruder 36. The intruder 36 might, at best, detect a slightly higher level of humidity.

If the intruder 36 handles or takes a valuable article 37, then the marker 7 can transfer from the article 37 onto his or her hands.

Spray heads 28 may be installed throughout (i.e. in most or all rooms or spaces in) a dwelling (e.g. house or apartment) or commercial premises (such as office or shop). Thus, the system may operate for a short time, for example 10 seconds, to deploy the marker in the air so the intruder may become marked regardless of the path he or she takes through the dwelling or premises.

Figure 4:
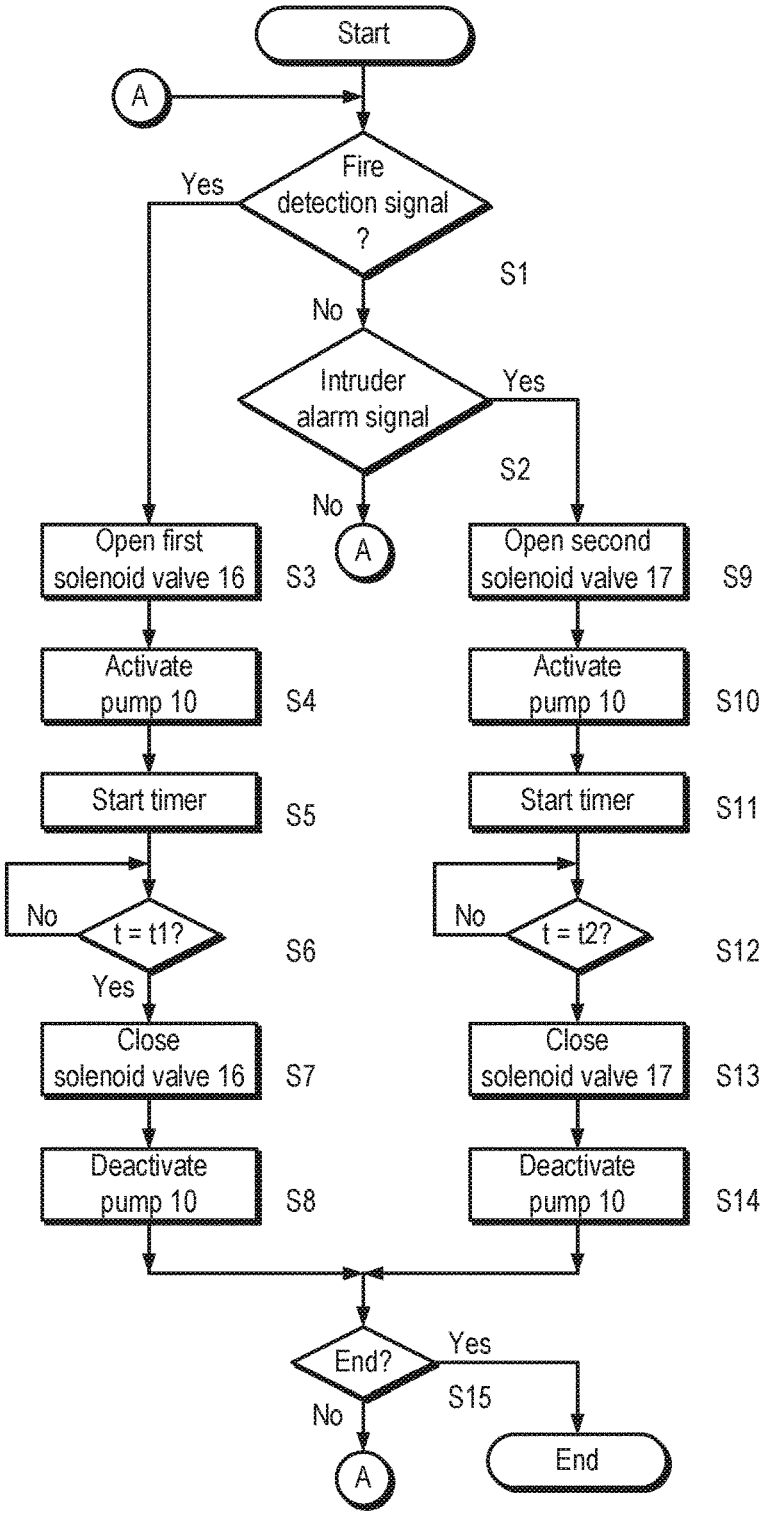
FIG. 4 is a process flow diagram of a method performed by a controller.

Referring to FIG. 4, a process flow diagram of a method of operation is shown.

Referring also to FIG. 1, the controller 9 polls to determine whether it receives a fire alarm activation signal or an intruder alarm activation signal (steps S1 & S2).

If the first detection signal (corresponding to detection of fire) is received, then the controller 9 opens the first solenoid valve 16 and activates the pump 10 (steps S3 & S4). The controller 9 starts a timer (step S5). Once the timer has elapsed (e.g. 30 minutes) (step S6) or if the user commands, via user interface 34, the controller 9 to stop, then the controller 9 closes the solenoid valve 16 and deactivates the pump 10 (steps S7 & S8).

If the second detection signal (corresponding to detection of an intruder) is received, then the controller 9 opens the second solenoid valve 17 and activates the pump 10 (steps S9 & S10). The controller 9 starts a timer (step S11). Once the timer has elapsed (e.g. 20 seconds) (step S12), then the controller closed the solenoid valve 17 and deactivates the pump 10 (steps S13 & S14).

It will be appreciated that many modifications may be made to the embodiments hereinbefore described.

A Venturi mixer need not be used. For example, a syringe pump or other injection means may be used.

More than one mixer may be used and/or more than one additive may be used. For example, a first mixer and a first additive (i.e. the marker) can be used for marking. A second, different mixer and a second, different additive can be used for fire protection.

The marker (or additive) can be added to the fire suppressant material after the pump.

A dual-path switch arrangement need not be used. A single path switch arrangement 11 comprising only one solenoid valve and a marker pump, injector or introducer for selectively adding the marker to the fire suppressant material can be used.

The system may operate only as a security system, i.e. the elements (such as the fire detector and the first path) which are need for fire protection may be omitted.

The invention claimed is:

1. A system comprising at least one spray head unit operable to supply fire suppressant material and marker to the at least one spray head unit for producing spray having a droplet size less than 1000 μm, each spray head unit comprising at least one spray head, wherein the system further comprises at least one pressure generator for supplying fire suppressant material to the at least one spray head unit under pressure;

a reservoir for storing the marker;

a mixer for selectively adding the marker to the fire suppressant material;

a controller that, in response to a first activation signal, causes fire suppressant material to spray out from the at least one spray head of the at least one spray head unit and, in response to a second activation signal, causes fire suppressant material and marker to spray out from the at least one spray head of the at least one spray head unit;

an inlet for fire suppressant material;

a first path disposed between the inlet and the at least one pressure generator;

a first valve that, when open, supplies fire suppressant material to the first path;

a second path disposed between the inlet and the at least one pressure generator; and a second valve that, when open, supplies fire suppressant material to the second path, wherein the mixer is disposed in the second path and is coupled to the reservoir.

2. A system according to claim 1, wherein the mixer comprises a Venturi mixer.

3. A system according to claim 1, wherein the at least one spray head unit is (are) wall-mounted spray head unit(s).

4. A system according to claim 1, further comprising:

at least one fire detector; and at least one intruder detector.

5. A system according to claim 1, comprising:

at least one pressurised container holding fire suppressant material and, optionally, an additive.

6. A fire suppression system comprising operability in more than one mode, the system operable, in a fire suppressing mode, to supply fire suppressant material to at least one spray head unit and, in a marking mode, to supply fire suppressant material and a marker to the at least one spray head unit, each spray head unit comprising at least one spray head, wherein the system further comprises at least one pressure generator for supplying fire suppressant material to the at least one spray head unit under pressure;

a reservoir for storing the marker;

a mixer for selectively adding the marker to the fire suppressant material;

a controller that, in response to a first activation signal, causes fire suppressant material to spray out from the at least one spray head of the at least one spray head unit and, in response to a second activation signal, causes fire suppressant material and marker to spray out from the at least one spray head of the at least one spray head unit;

an inlet for fire suppressant material;

a first path disposed between the inlet and the at least one pressure generator;

a first valve that, when open, supplies fire suppressant material to the first path;

a second path disposed between the inlet and the at least one pressure generator; and a second valve that, when open, supplies fire suppressant material to the second path, wherein the mixer is disposed in the second path and is coupled to the reservoir.

7. A system according to claim 6, wherein the at least one spray head unit comprises at least one spray head unit for producing spray having a droplet size less than 1000 μm.

8. A system according to claim 6, wherein the system is configured, in the fire suppressing mode, to supply the fire suppressant material to the at least one spray head unit for a first period of time and/or until instructed to stop by a user.

9. A system according to claim 8, wherein the first period of time is at least 10 minutes.

10. A system according to claim 8, wherein the system is configured, in marking mode, to supply the fire suppressant material and the marker to the at least one spray head unit for a second period of time.

11. A system according to claim 10, wherein the second period of time is no more than 1 minute.

12. A system according to claim 6, wherein the at least one spray head unit is (are) wall-mounted spray head unit(s).

13. A system according to claim 6, further comprising:

at least one fire detector; and at least one intruder detector.

14. A system according to claim 6, comprising:

at least one pressurised container holding fire suppressant material.

15. A system according to claim 5, wherein the at least one pressurised container holds the fire suppressant material and, when included, the optional additive.

16. A system according to claim 14, wherein the at least one pressurised container holds the fire suppressant material and, when included, an optional additive.

17. A fire suppressant system according to claim 6, wherein the mixer comprises a Venturi mixer.

18. A kit for a fire suppression system, the kit comprising:

at least one spray head unit;

at least one pressure generator for supplying fire suppressant material to the at least one spray head unit under pressure;

a reservoir for storing a marker;

a mixer for selectively adding the marker to the fire suppressant material;

a controller which, in response to a first activation signal, causes fire suppressant material to spray out from the at least one spray head of the at least one spray head unit and, in response to a second activation signal, causes fire suppressant material and marker to spray out from the at least one spray head of the at least one spray head unit;

an inlet for fire suppressant material;

a first path disposed between the inlet and the at least one pressure generator;

a first valve that, when open, supplies fire suppressant material to the first path;

a second path disposed between the inlet and the at least one pressure generator; and a second valve that, when open, supplies fire suppressant material to the second path, wherein the mixer is disposed in the second path and is coupled to the reservoir.

19. A kit according to claim 18, wherein the at least one pressure generator, the reservoir, the mixed and controller are provided in a unit, the unit comprising:

a first interface for receiving the first activation signal;

a second interface for receiving the second activation signal; and an outlet for supplying the fire suppressant material under pressure.

20. A kit according to claim 18, wherein the mixer comprises a Venturi mixer.

21. A method of operating a controller of a fire suppression system according to claim 1, the method comprising:

in response to the first activation signal, causing the at least one pressure generator to supply fire suppressant material to the at least one spray head unit under pressure; and in response to the second activation signal, causing the at least one pressure generator to supply fire suppressant material and marker to the at least one spray head unit under pressure.

* * * * *